United States Patent [19]

Schmidt

[11] 4,083,659

[45] Apr. 11, 1978

[54] MOTOR-DRIVEN LIQUID-RING PUMP INCLUDING A LIQUID SEPARATOR

[75] Inventor: Heribert Schmidt, Erlangen, Germany

[73] Assignee: Siemens Aktiengesellschaft, Munich, Germany

[21] Appl. No.: 721,695

[22] Filed: Sep. 9, 1976

[30] Foreign Application Priority Data

Sep. 22, 1975 Germany ..... 2542221

[51] Int. Cl.[2] ..... F04C 19/00

[52] U.S. Cl. ..... 417/68

[58] Field of Search ..... 417/68, 69, 319, 223

[56] References Cited

U.S. PATENT DOCUMENTS

| | | | |
|---|---|---|---|
| 1,867,813 | 7/1932 | Easton | 417/69 |
| 3,025,965 | 3/1962 | Bergman et al. | 417/319 X |
| 3,262,328 | 7/1966 | Fuqua | 417/319 X |
| 3,289,918 | 12/1966 | Adams | 417/68 |

FOREIGN PATENT DOCUMENTS

| | | | |
|---|---|---|---|
| 1,428,250 | 1/1969 | Germany | 417/68 |
| 683,743 | 12/1952 | United Kingdom | 417/319 |

*Primary Examiner*—William L. Freeh
*Assistant Examiner*—Edward Look
*Attorney, Agent, or Firm*—Kenyon & Kenyon, Reilly, Carr & Chapin

[57] ABSTRACT

A motor-driven liquid-ring pump in which the pump and the motor are disposed in tandem and are coupled to each other by means of a coupling and/or a transmission and including a liquid separator coupled to the pump. The improvement of the invention comprises the separator being disposed between the motor and the pump and at least partially enclosing the coupling and/or the transmission.

4 Claims, 3 Drawing Figures

MOTOR-DRIVEN LIQUID-RING PUMP INCLUDING A LIQUID SEPARATOR

BACKGROUND OF THE INVENTION

1. Field of the Invention

This invention relates generally to liquid-ring pumps, and in particular to an improved construction for a motor-driven liquid-ring pump including a liquid separator.

2. Description of the Prior Art

Motor-driven liquid-ring pumps in which the pump and motor are disposed in tandem and are coupled to each other by means of a coupling and/or a transmission and which include a liquid separator following the pump, are known in the art. See, for example, Siemens-Zeitschrift, 1970, pages 387–392.

In such liquid-ring pumps, the liquid separator is mounted either above or next to the pump or, alternatively, is designed as the base frame on which the pump and motor are mounted. See, for example, German Pat. No. 969,928. Although the latter design results in a considerable saving of space, the design is nonetheless expensive to manufacture in certain situations, for example, when active media require the entire frame to be fabricated of, for example, alloy steel. In addition, certain individual applications also present difficulties in starting due to different geodetic heights of the pump and the liquid level in the separator.

SUMMARY OF THE INVENTION

It is therefore an object of the present invention to overcome the aformentioned disadvantages of heretofore known liquid-ring pumps and to provide an improved construction for a motor-driven liquid-ring pump including a liquid separator which is compact and sturdy in design, and in which the liquid levels in the liquid-ring pump and the liquid separator are disposed at about the same height.

These and other objects are achieved in a motor-driven liquid-ring pump in which the pump and the motor are disposed in tandem and are coupled to each other by means of a coupling and including a liquid separator coupled to the pump. The improvement of the invention comprises the separator being disposed between the motor and the pump and at least partially enclosing the coupling. The coupling may comprise a transmission coupled to the pump and the motor.

The foregoing arrangement permits the liquid-ring pump to be fabricated in a compact and cost-effective manner and, additionally, protects the liquid-ring pump coupling from accidental damage by contact with other objects. Finally, such an arrangement permits a noise suppressor for the transmission to be eliminated.

In a further embodiment of the invention, the separator comprises a U-shaped, vertically-mounted separator having parallel legs which laterally encloses the coupling and, where applicable, the transmission. The motor of the pump preferably has a lower overall height than the pump so that the separator can be expanded, i.e., extends into the open space above the motor of the pump.

In each of the foregoing design arrangements, the separator preferably has a height which is approximately the same as the overall height and width of the pump so that there are no parts of the pump protruding therefrom.

These and other novel features and advantages of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
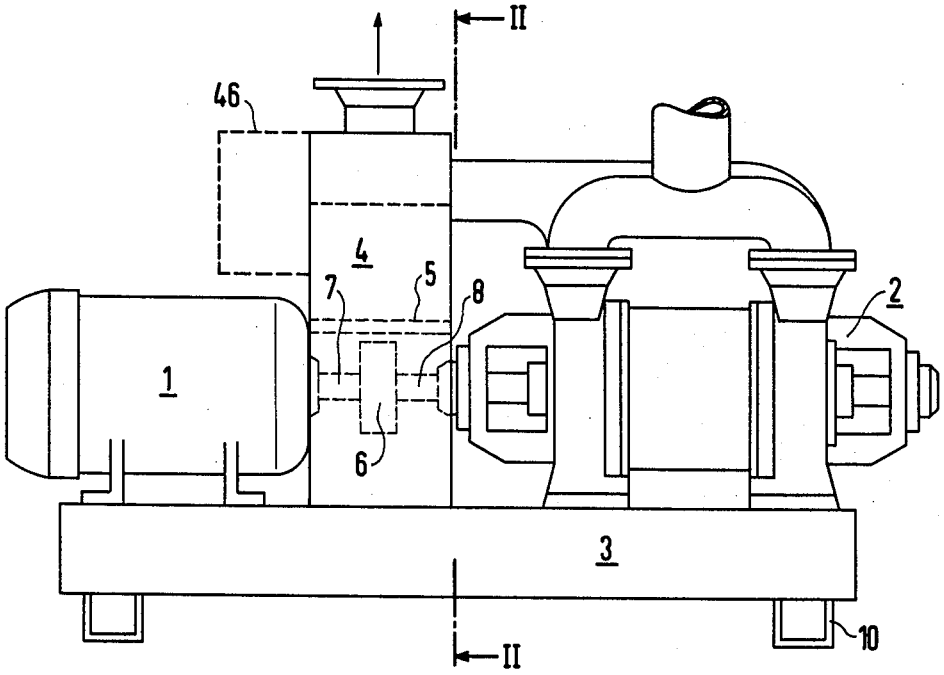
FIG. 1 is a side view of an improved motor-driven liquid-ring pump including a liquid separator constructed according to the present invention.

Referring now to the drawings, in particular to FIG. 1, there is shown a liquid-ring pump 2 driven by an electric motor 1 both of which are disposed on a common base frame 3 supported on leg members 10. The shaft of motor 7 is coupled to the shaft 8 of the liquid-ring pump by means of a coupling 6, illustrated by the dashed lines in FIG. 1. The coupling is surrounded by a liquid separator 4 which is U-shaped and has a liquid level indicated by the reference numeral 5.

Figure 2:
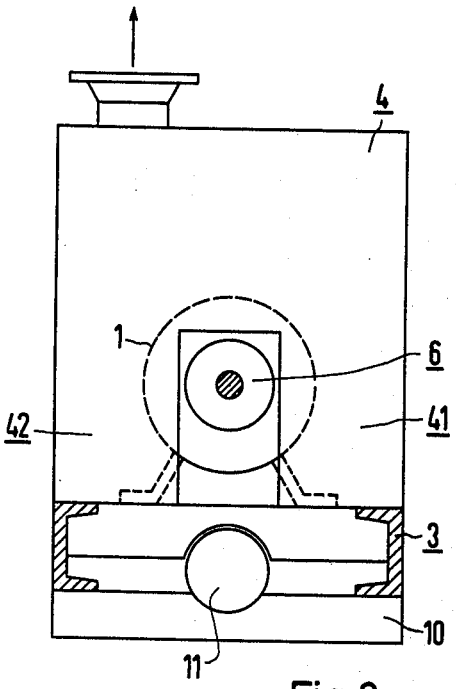
FIG. 2 is a sectional view of the liquid-ring pump taken along section II—II of FIG. 1.

As illustrated in FIG. 2, the separator is vertically mounted and includes legs 41 and 42 which laterally enclose the coupling so that the coupling is protected from contact with other objects. As is evident from the drawings, the space between motor 1 and pump 2 is optimally utilized by the described design and, accordingly, a compact and sturdy design for the liquid-ring pump is achieved, particularly where the overall height and width of the separator are matched to the maximum outside dimensions of pump 2.

Figure 3:
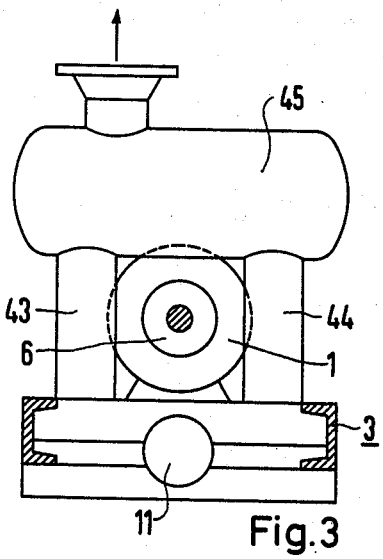
FIG. 3 is a schematic illustration of a further embodiment of an improved motor-driven liquid-ring pump including a liquid separator constructed according to the present invention.

The rectangular separator illustrated in FIGS. 1 and 2 of the drawings is advantageously utilized in vacuum applications, i.e., when practically atmospheric pressure exists in the liquid separator. In compressors, however, the embodiment of the invention illustrated in FIG. 3 is preferably utilized. In this embodiment of the invention, legs 43 and 44 and the cross-coupling 45 of the liquid separator are cylndrical in shape. The legs and cross-coupling may comprise, in their simplest form, tubular members. Similar to the embodiment illustrated in FIGS. 1 and 2, the liquid separator is preferably mounted directly on base frame 3. In either embodiment, a heat exchanger 11, which is required for the closed circuit of the liquid-ring pump, may be disposed between the lengthwise beams which form frame 3.

The foregoing arrangement not only has the advantage of a more compact structure than that which is obtained by utilizing a top-mounted liquid separator, but, in addition, provides a communicative coupling between the pump and the liquid separator which prevents flooding of the pump after the liquid-ring pump is shut down.

The liquid separator may be designed so as to extend into the open space which is available above motor 1 of the pump. Such a design is illustrated in the drawings by the dashed lines 46 in FIG. 1.

In the foregoing specification, the invention has been described with reference to specific exemplary embodiments thereof. It will, however, be evident that various modifications and changes may be made thereunto without departing from the spirit and scope of the invention as set forth in the appended claims. The specification and the drawings are, accordingly, to be regarded in an illustrative rather than in a restrictive sense.

What is claimed is:

1. In a motor-driven liquid-ring pump in which the pump and the motor are disposed in tandem and are coupled to each other by means of a coupling, and including a liquid separator coupled to said pump, the improvment comprising said separator being disposed between said motor and said pump and at least partially enclosing said coupling, said separator comprising a U-shaped, vertically-mounted separator having parallel legs which laterally enclose said coupling.

2. The pump recited in claim 1, wherein said coupling comprises a transmission.

3. The pump recited in claim 1, wherein said motor has an overall height which is lower than said pump, and wherein said separator extends into the space above said motor.

4. The pump recited in claim 1, wherein said liquid separator has approximately the same overall height and width as that of said pump.

* * * * *